United States Patent [19]

Hanyu et al.

[11] Patent Number: 4,949,657

[45] Date of Patent: Aug. 21, 1990

[54] SEWING MACHINE WITH A DEVICE FOR AMENDING THREAD TIGHTENING BY NEEDLE POSITIONS

[75] Inventors: Susumu Hanyu; Noboru Kasuga; Kazumasa Hara; Mikio Koike, all of Tokyo, Japan

[73] Assignee: Janome Sewing Machine Co. Ltd., Tokyo, Japan

[21] Appl. No.: 266,385

[22] Filed: Nov. 2, 1988

[30] Foreign Application Priority Data

Nov. 6, 1987 [JP] Japan ..... 62-279084

[51] Int. Cl.[5] ..... D05B 3/02; D05B 47/04; D05B 49/00

[52] U.S. Cl. ..... 112/121.13; 112/241; 112/254; 112/453

[58] Field of Search ..... 112/254, 255, 302, 453, 112/157, 443, 121.13, 241

[56] References Cited

U.S. PATENT DOCUMENTS 4,690,083 9/1987 Hara et al. ..... 112/254
4,706,589 11/1987 Tsukioka ..... 112/302
4,793,273 12/1988 Hara et al. ..... 112/254

FOREIGN PATENT DOCUMENTS 56-23074 3/1981 Japan .

*Primary Examiner*—Peter Nerbun
*Attorney, Agent, or Firm*—Michael J. Striker

[57] ABSTRACT

A sewing machine comprises a thread deflecting device arranged between a thread take-up lever and a needle and which in response to a swinging movement of a needle bar effected in response to selection of a zigzag stitch, deflects the upper thread laterally of a fabric feeding direction. A thread blocking device is provided on one side of the thread deflecting device. The sewing machine further comprises an actuator operated in response to actuation of a zigzag stitch pattern selecting key to move the thread blocking device to an operative position thereof. The thread blocking device in the operative position blocks the upper thread as it is deflected in one direction by the thread deflecting device to give a predetermined degree of tension to the upper thread, so that the stitch is tightened on one side of the zigzag stitch in addition to the tightening of the stitch by a thread take-up lever.

4 Claims, 5 Drawing Sheets

FIG_1
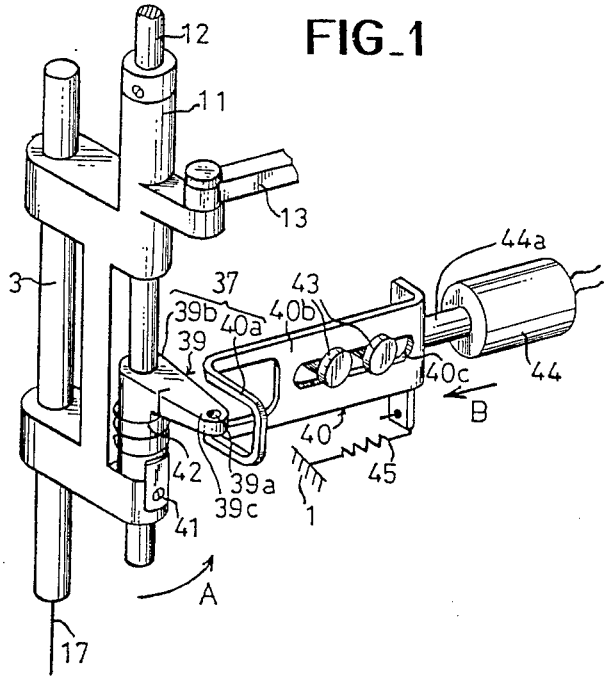
FIG_2
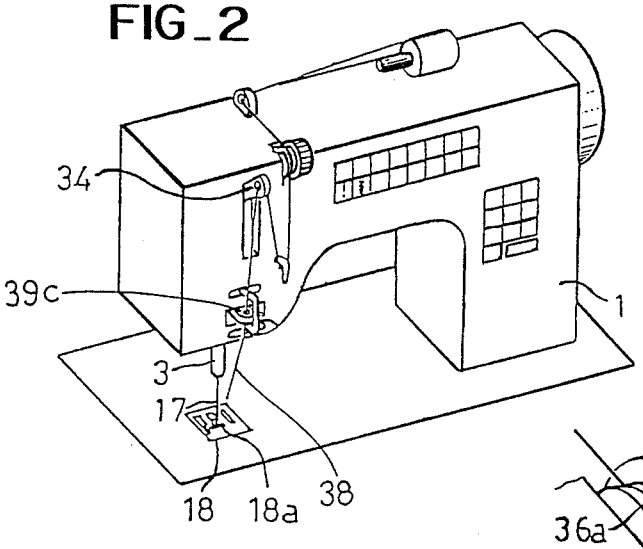
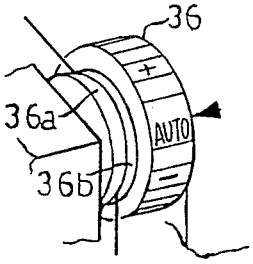
FIG_3

FIG_6(a)
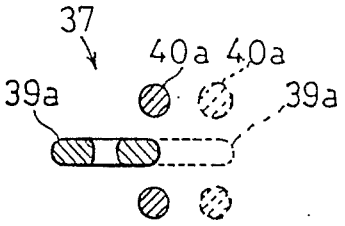
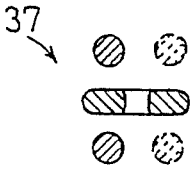
FIG_6(b)
FIG_5(a)
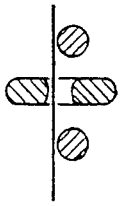
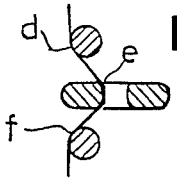
FIG_5(b)
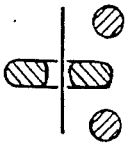
FIG_5(c)
FIG_4
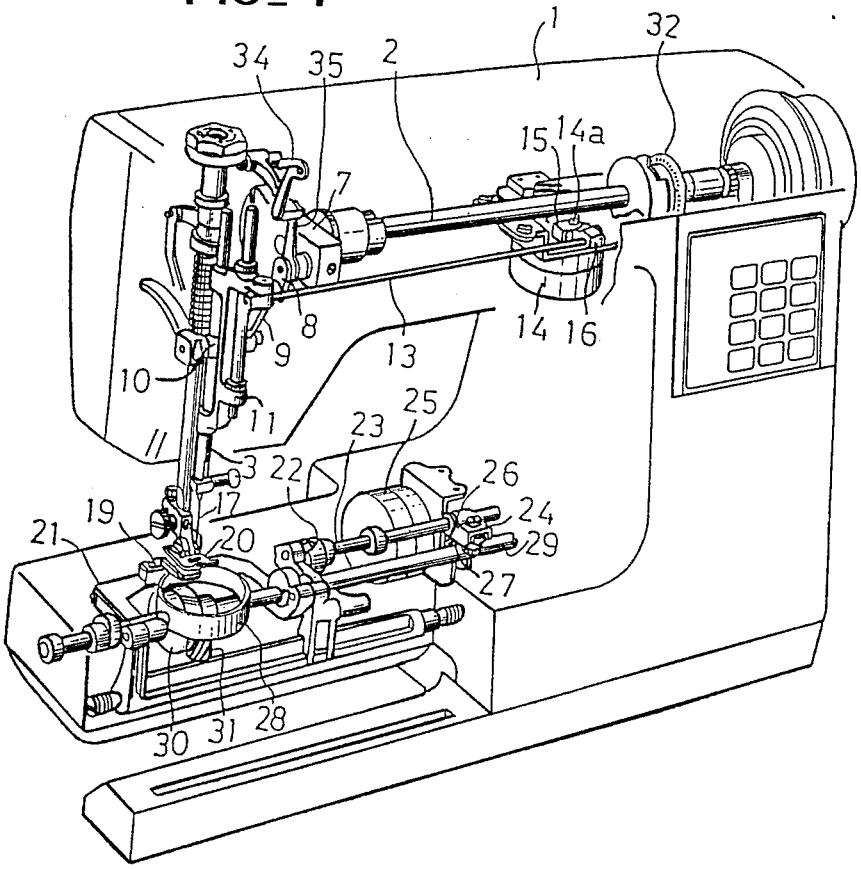

SEWING MACHINE WITH A DEVICE FOR AMENDING THREAD TIGHTENING BY NEEDLE POSITIONS

FIELD OF THE INVENTION

The present invention relates to a sewing machine and particularly to a mechanism for adjusting an upper thread tension to prevent excessive pull-out of the upper thread by a lower thread during zigzag stitching.

BACKGROUND OF THE INVENTION

Straight stitches of lock stitching may be divided into normal stitches as shown in FIG. 7, and hitch stitches as shown in FIG. 8. If those are mixed, the stitches are disordered as seen in FIG. 11. In general, it is desirable to form a series of normal stitches which will not cause untwisting of the upper thread.

The normal stitches and the hitch stitches are produced in dependence upon whether a needle drops on a left side or a right side of the lower thread drawn from a thread source in a loop taker, as illustrated in FIGS. 9 and 10.

When the needle drops on the right side of the lower thread, the normal stitches are formed as shown in FIGS. 9(*a*) to (*g*). When the needle drops on the left side of the lower thread, the hitch stitches are formed as shown in FIGS. 10(*a*) to (*g*).

Therefore, in order to drop the needle on the right side of the lower thread as shown in FIG. 9, the lower thread need be supplied at the left side of the loop taker leftward of a lateral elongate needle dropping hole 18*a* as seen in FIG. 12(*a*), because straight stitching is generally carried out with the needle dropped at the left side of the needle hole.

However, in this case if the zigzag stitching is carried out, the lower thread will pull out the upper thread too much when the lower thread is interlocked with the upper thread at the right side of the zigzag stitch in contrast to the normal zigzag stitch. This results from different stitching conditions at the right and left sides of the zigzag stitch as shown in FIG. 12(*a*). Namely, because of different distances from the lower thread supply point to the right and left sides.

The applicants' Japanese utility model Laid open application 56-23,074 (1981) discloses a mechanism for changing the position of the lower thread supply point when the zigzag stitching is carried out as shown in FIG. 12(*b*) so that the distances from the lower thread supply point to the left L and right R sides of the zigzag stitch are substantially the same. However, this mechanism is arranged in a narrow space between the needle plate and the loop taker, and its structure is rather complicated and manufacture is costly because of the need to meet space requirements.

SUMMARY OF THE INVENTION

The object of the present invention is to provide means that prevents pulling the upper thread by a lower thread too much at one end needle position. The object of the invention is achieved by providing in a sewing machine, a thread deflecting device arranged between a thread take-up lever and a needle and which, in response to a swinging movement of the needle bar, effected in response to selection of a zigzag stitch, deflects the upper thread laterally of a fabric feeding direction; and a thread blocking device on one side of the thread deflecting device. The sewing machine according to the invention comprises an actuator that, in response to actuation of the zigzag stitch pattern selecting key, moves the thread blocking device to an operation position thereof in which the thread blocking device blocks the upper thread as it is being deflected, to provide the upper thread with a predetermined tension so that the stitch is tightened on one side of the zigzag stitch in addition to being tightened by the thread take-up lever.

The present invention both as to its construction so to its mode of operation, together with all objects and advantages thereof, will be best understood from the following detailed description of the preferred embodiment when read with reference to the accompanying drawings.

BRIEF DESCRIPTION OF DRAWINGS

FIG. 1 is a perspective view of the device according to the invention;

FIG. 2 is a perspective view of a sewing machine that includes the device of the invention;

FIG. 3 is a perspective view of an upper thread tension device;

FIG. 4 is a perspective view of internal mechanisms of the sewing machine according to the invention;

FIG. 5(*a*)–5(*c*) are explanatory views showing blocking of the upper thread in operative position of the thread blocking means when a pattern of zigzag stitches is selected;

FIGS. 6(*a*)–6(*b*) are explanatory views showing schematically blocking means in operative and inoperative positions thereof;

FIG. 13 is a plan view of an upper shaft rotation phase detector; and

DETAILED DESCRIPTION OF PREFERRED EMBODIMENT

Figure 7:
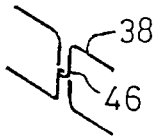
FIGS. 7–8 show perspective views of normal and hitch stitches, respectively.
Figure 8:
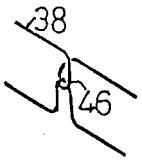
Figure 11:
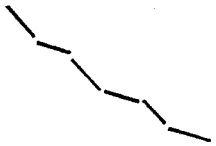
FIG. 11 is an explanatory view showing mixing of normal and hitch stitches.

A reference will be made in detail to an embodiment of the invention with the attached drawings.

FIG. 4 shows that a machine frame 1 includes a needle bar 3 operatively connected to an upper drive shaft 2 rotatably by a driving motor (not shown).

The needle bar 3 is slidably inserted into a needle bar support 11 and is fixedly connected to a needle holder 10 which is connected to a needle bar crank 8 through a crank rod 9. A needle 17 is attached to the lower end of the needle bar 3. The crank 8 is operatively connected to a balance weight 7 secured to one end of the upper shaft 2 for rotation therewith. The needle bar support 11 is swingably mounted on a vertical shaft 12 secured to the machine frame 1. The needle bar support 11 is connected to one end of a transmission rod 13 which has the other end thereof connected to an arm 15 secured to an output shaft 14*a* of a stepping motor 14 for controlling the needle position.

A feed dog 19 that transports a fabric relative to the needle, is mounted on a horizontal feed arm 21 to be driven by the upper drive shaft 2 via a lower drive shaft 79. The movement of the horizontal feed arm 21 is adjusted by adjusting the angular position of a member 22 fixed to one end of an adjusting shaft 23 which has the other end secured to an arm 24 connected to an output shaft of a feed control stepping motor 25 by a crank 26 and a link 27.

Figure 14:
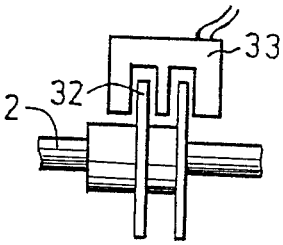

In FIG. 14, the reference numeral 32 designates a disc secured on the upper drive shaft 2 for rotation with the upper drive shaft 2 and has a plurality of slits formed thereon. A photocoupling 33 is secured to the machine frame 1. The disc and the photocoupling form a detecor of rotational phases (angles) of the upper drive shaft 2.

A thread take-up lever 34 seen in FIG. 4 is connected to the upper drive shaft 2 via a link 35 and a balance weight 7. An upper thread tension device 36 in FIG. 3 has a known structure for applying bias pressure to an upper thread 38 passing between a pair of thread holding discs 36*a* and 36*b*.

The reference numeral 37 designates a mechanism for applying tension to the upper thread. The mechanism 37 comprises an upper thread deflecting member 39 and a thread blocking member 40.

The upper thread deflecting member 39 is, as seen in FIG. 1, formed with a bearing 39*b* pivotably mounted on the shaft 12 and a thread deflecting part 39*c* having a thread passing hole 39*a*. The bearing 39*b* is formed with an engaging part 39*d* (FIG. 15) for contacting stopper 41 secured to the needle bar supporter 11. The upper thread deflecting member 39 is normally biased in a direction of arrow A by a spring 42, so that an engaging member 39*d* is pressed against the stopper 41. The thread deflecting arm 39*c* projects out of an opening of the machine frame 1 as seen in FIG. 2.

The thread blocking member 40 is formed with a limb 40*a* and a main body 40*b* and is arranged on a side of the deflecting member 39 so that the deflecting arm 39*c* passes through the limb 40*a* when it swings in one direction. A pair of stepped screws 43 are secured to the machine frame 1 in - lateral alignment and positioned in an elongate slot 40*c* of the main body 40*b*, so that the thread blocking member 40 may be displaced laterally towards and away from the arm 39*c*.

The thread blocking member 40 is connected at its end to an output shaft 44*a* of a solenoid 44 fixed to the machine frame 1, and a spring 45 is disposed between the end of the resistor 40 and the machine frame 1 so that the output shaft 44*a* is normally biased in a direction of arrow B, when solenoid 44 which is connected to a pattern selecting means (not shown), is not energized.

The solenoid 44 is energized when straight stitching is selected, and pulls back an output shaft 44*a* against the action of the spring to displace the thread blocking member 40 away from the thread deflecting member 39, and hold the limb 40*a* in a position shown with dotted lines in FIGS. 6(*a*) and 6(*b*). The thread blocking member is held in an inoperative position in which the limb 40*a* does not act on the upper thread that passes through the thread deflecting arm 39*c* independent of whether straight stitching is carried out on the left or the right of the needle hole 18*a*.

In FIGS. 6(*a*) and (*b*), if the solenoid is deenergized when the zigzag stitching is selected, the output shaft 44*a* is pulled toward the thread deflecting arm 39*c* by spring 45, and the limb 40*a* of the thread blocking member 40 is displaced toward the thread deflecting arm 39*c*. The limb 40*a* is held, thus in an operative position shown by solid lines in FIGS. 6(*a*) and 6(*b*). In this position when the thread deflecting arm 39*c* moves to the right side end, the upper thread running through the hole 39*a* of the arm 39*c* is blocked by the limb 40*a*. When the arm 39*c* moves to the left side end, the upper thread 39 is away from the limb 40*a*, and the limb 40*a* does not act thereon as shown in FIG. 5(*c*).

Since the upper thread deflecting member 39 is moved in association with the lateral swinging movement of the needle bar 3 when zigzag stitching is made, the hole 39*a* of the arm 39*c* is positioned as shown in FIG. 5(*a*) where the upper thread does not touch the limb at the upper dead point of the thread take-up lever 34 in the both cases of the needle dropping at the left and right end positions for forming the zigzag stitch. At the phase of the needle penetrating the fabric, the position of the hole 39*a* of the arm 39*c* is different in dependence upon the two end positions of the needle dropping hole 18*a*.

Figure 12A:
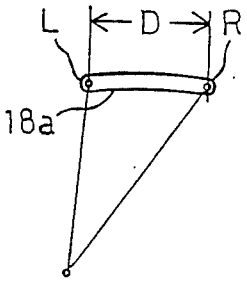
FIGS. 12(*a*)–12(*b*) are explanatory views showing positions of the lower thread supply point.
Figure 12B:
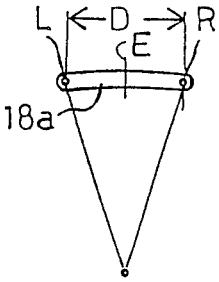
Figure 13A:
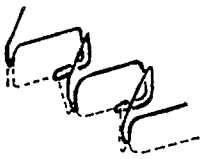
FIGS. 13(*a*)–13(*b*) are perspective views showing, respectively, thread biased zigzag stitches and thread balanced normal zigzag stitches.
Figure 13B:
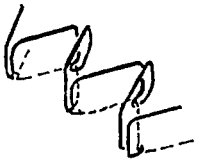
Figure 15:
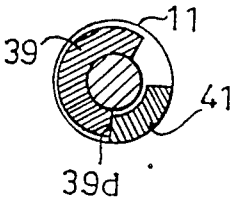
FIG. 15 is a cross-sectional plan view of a driving device for thread deflecting means.
Figures 9A, 9B, 9C, 9D, 9E, 9F, 9G:
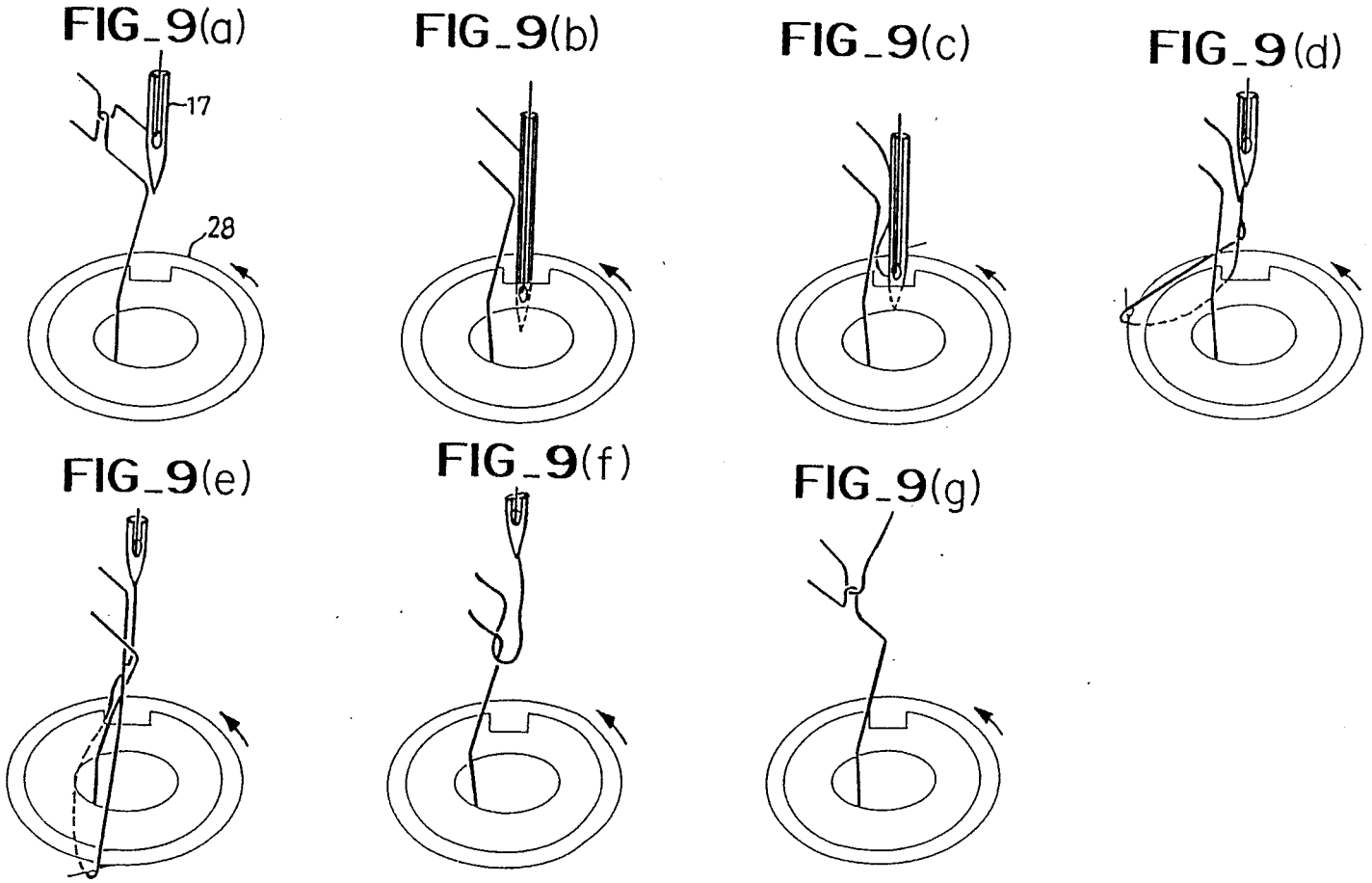
FIGS. 9(*a*)–9(*g*) are explanatory views showing formation of normal stitches.
Figure 10A:
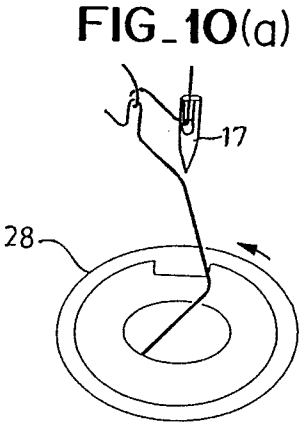
FIGS. 10(*a*)–10(*g*) are explanatory views showing formation of hitch stitches.
Figure 10B:
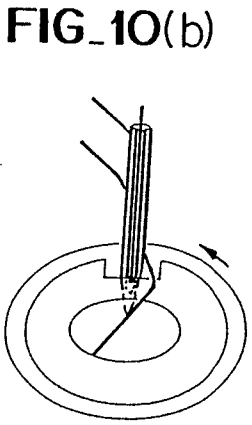
Figure 10C:
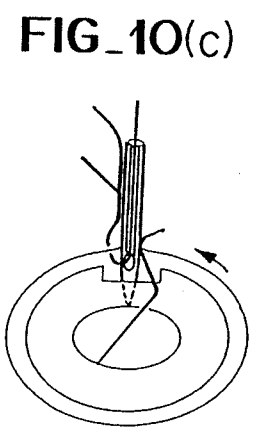
Figure 10D:
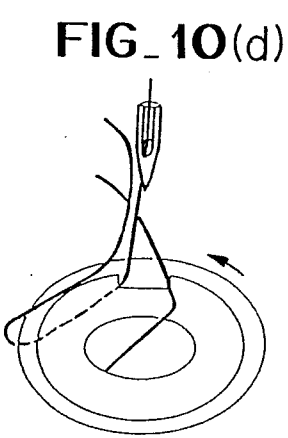
Figure 10E:
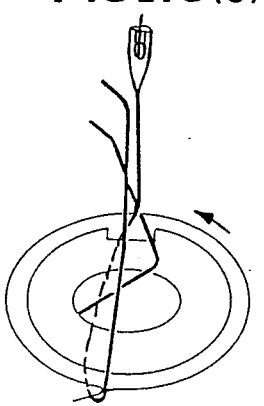
Figure 10F:
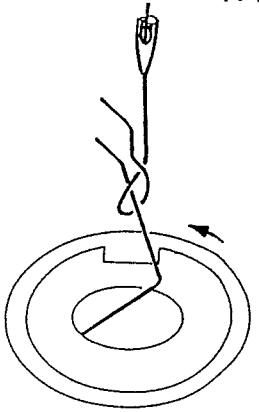
Figure 10G:
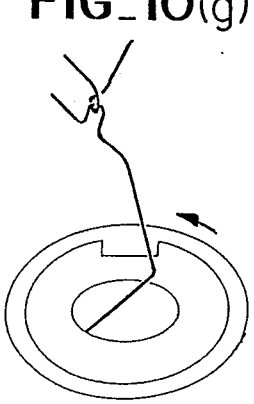

As it is apparent from FIGS. 1 and 15, if the needle support is turned clockwise around the vertical shaft 12, the needle 17 will drop to the right side end R in FIG. 12 where the upper thread and the lower thread are interlocked with each other as the needle moves upward. Meantime, the stopper 41 secured to the needle bar support 11, turns the thread deflecting member 39 clockwise against the action of the spring 42 as shown in FIG. 5(*c*) where the upper thread 38 is far away from the limb 40*a* of the thread blocking member so that the limb 40*a* does not act on the upper thread.

When the needle 17 reaches the upper dead point thereof while the thread take-up lever 34 begins to move upward from its lower dead point, the needle bar support 11 is turned counterclockwise, and the stopper 41 turns in the same direction. Meantime, the thread deflecting member 39 is also turned counterclockwise by spring 42 until the thread deflecting member 39 passes through the limb 40*a* and takes a position shown in FIG. 5(*b*), in which the limb 40*a* blocks the upper thread 38 running through the thread deflecting member 39, and, thus, applies tension to the upper thread at three points (d, e, f) as shown in FIG. 5(*b*).

Simultaneously, the needle comes down to the left side L of the needle dropping hole 18*a* while the thread take-up lever 34 moves to the upper dead point thereof to tighten the stitch, that is to interlock upper and lower threads at the right side end R of the zigzag stitch. In short, the thread blocking limb 40*a* and the thread deflecting member 39 cooperate to apply tension to the upper thread in addition to the thread tightening operation of the thread take-up lever 37. This prevents the upper thread from being excessively pulled out by the lower thread which is normally placed under a predetermined tension and is drawn out against the tension applied thereto in the process of interlocking with the loop taker.

What is claimed is:

1. A sewing machine comprising a needle bar having a lower end; a needle for carrying an upper thread and attached to said lower end of said needle bar; a vertical shaft; a needle bar support swingable around said vertical shaft to swing said needle laterally with respect to a fabric feeding direction, an upper drive shaft operatively connected with said needle bar and rotatable to vertically reciprocate said needle bar on said needle bar support; a loop taker for carrying a lower thread and operatively connected with said upper drive shaft for rotation in synchronism with said needle, said loop taker and said needle cooperating to interlock the upper thread and the lower thread to form a stitch each time said needle is displaced downward; a thread take-up lever operatively connected to said upper drive shaft for vertical reciprocation in synchronism with said needle to feed the upper thread to said needle upon downward movement of said take-up lever and to tighten the stitch upon upward movement of said take-up lever; thread deflecting means arranged between said thread take-up lever and said needle for deflecting the upper thread laterally of the fabric feeding direction in response to swinging movement of said needle bar effected in response to selection of zigzag stitch pattern data stored in a memory of said sewing machine; thread blocking means arranged on one side of said thread deflecting means and movable relative to said thread deflecting means between inoperative and operative positions; and actuating means for moving said thread blocking means to the operative position of said blocking means in response to selection of the zigzag stitch pattern data, said thread blocking means in the operative position thereof blocking the upper thread as the upper thread is being deflected in one direction by said thread deflecting means for providing a predetermined degree of tension of the upper thread to thereby tighten the stitch on one side of the zigzag stitch in addition to tightening the stitch by said thread take-up lever.

2. A sewing machine as set forth in claim 1, wherein said thread deflecting means includes an arm having an end rotatbly supported on said vertical shaft and operatively connected to said needle bar biased by a spring arranged between said needle bar support and said arm.

3. A sewing machine as set forth in claim 1, wherein said thread blocking means includes a member having a limb movable toward said thread deflecting means when said thread deflecting means is in operative position thereof, and away from said thread deflecting means when said thread deflecting means is in inoperative position thereof, said limb blocking the upper thread upon deflection of the upper thread in the one direction by said thread deflecting means.

4. A sewing machine as set forth in claim 1, wherein said actuating means includes a solenoid which is energized for moving said thread blocking means to the inoperative position of said thread blocking means and is deenergized for moving said thread blocking means to the operative position of said thread blocking means.

* * * * *